US006615703B2

(12) United States Patent
Kendall

(10) Patent No.: US 6,615,703 B2
(45) Date of Patent: Sep. 9, 2003

(54) HYDRAULIC OR PNEUMATIC CYLINDER

(75) Inventor: Jeffrey Kendall, Wingfield (AU)

(73) Assignee: Razorback Vehicles Corporation Limited, Edgecliff New South Wales (AU)

( * ) Notice: Subject to any disclaimer, the term of this patent is extended or adjusted under 35 U.S.C. 154(b) by 0 days.

(21) Appl. No.: 10/111,789

(22) PCT Filed: Apr. 19, 2001

(86) PCT No.: PCT/AU01/00446

§ 371 (c)(1),
(2), (4) Date: Apr. 26, 2002

(87) PCT Pub. No.: WO01/92732

PCT Pub. Date: Dec. 6, 2001

(65) Prior Publication Data

US 2002/0148349 A1 Oct. 17, 2002

(30) Foreign Application Priority Data

May 31, 2000 (AU) ..... PQ 7867

(51) Int. Cl.[7] ..... F15B 15/26
(52) U.S. Cl. ..... 91/44; 91/45; 92/24; 92/28
(58) Field of Search ..... 91/41, 42, 43, 91/44, 45; 92/24, 27, 28

(56) References Cited

U.S. PATENT DOCUMENTS 2,139,185 A * 12/1938 Engel ..... 91/44
2,532,768 A * 12/1950 Halward ..... 91/44
3,889,576 A * 6/1975 Sheffer et al. ..... 91/45
4,524,676 A * 6/1985 Rogers ..... 91/44
4,635,536 A 1/1987 Liu et al.
4,784,037 A * 11/1988 Fabyan et al. ..... 91/44
5,048,656 A * 9/1991 Braun ..... 92/24
5,193,431 A * 3/1993 Propsting et al. ..... 91/45
5,365,828 A * 11/1994 Sperber et al. ..... 91/44
5,522,303 A * 6/1996 Stoll et al. ..... 92/27

FOREIGN PATENT DOCUMENTS

DE 19521783 A1 1/1996
EP 0458051 B1 8/1993
JP 7-332312 A 12/1995

* cited by examiner

*Primary Examiner*—Edward K. Look
*Assistant Examiner*—Thomas E. Lazo
(74) *Attorney, Agent, or Firm*—Townsend and Townsend and Crew, LLP

(57) ABSTRACT

A pneumatic or hydraulic cylinder (10) having a bore (12) cooperating with a piston (18). Extending from the piston (18) is a piston rod (37). There is further provided a pawl (26) which is engageable with the piston (18) to retain the piston (18) at a desired location. The pawl (26) is moved from engagement with the piston (18) upon fluid under pressure being delivered to one end of the cylinder (10).

12 Claims, 1 Drawing Sheet

HYDRAULIC OR PNEUMATIC CYLINDER

TECHNICAL FIELD

The present invention relates to pneumatic and hydraulic cylinders.

BACKGROUND OF THE INVENTION

Hydraulic and pneumatic cylinders suffer from the disadvantage that should there be any leakage, the cylinder will either extend or retract depending on its preloaded condition.

OBJECT OF THE INVENTION

It is the object of the present invention to overcome or substantially ameliorate the above disadvantage.

SUMMARY OF THE INVENTION

There is disclosed herein a hydraulic or pneumatic cylinder including:

a bore, the bore generally surrounding a chamber having opposite ends;

a piston in said bore and co-operating therewith to divide said chamber into a first and a second sub-chamber;

a piston rod fixed to and extending from said piston and extending beyond one of said ends;

means closing said opposite ends;

releasable locking means to retain said piston at a desired location within said bore, said locking means being released to permit movement of said piston upon delivery of a fluid under pressure to one of said chambers; and duct means to provide for fluid flow from said second sub-chamber to said first sub-chamber when said locking means is engaged with said piston to retain said piston at said desired location.

Preferably, the locking means includes a pawl mounted in said body, and a recess in said piston, said recess being alignable with said pawl so as to be engaged therewith to retain the piston at said desired location, said pawl being movable between a first position at which it is engaged within said recess and a second position spaced from said recess to provide for movement of said piston.

Preferably, the cylinder includes a spring urging the pawl into engagement with said recess.

Preferably, the delivery of fluid under pressure to said first sub-chamber causes movement of said pawl from the first position to the second position thereof.

BRIEF DESCRIPTION OF THE DRAWINGS

A preferred form of the present invention will now be described by way of example with reference to the accompanying drawing which schematically depicts in section side elevation a pneumatic or hydraulic cylinder.

DETAILED DESCRIPTION OF THE PREFERRED EMBODIMENTS

Figure 1:
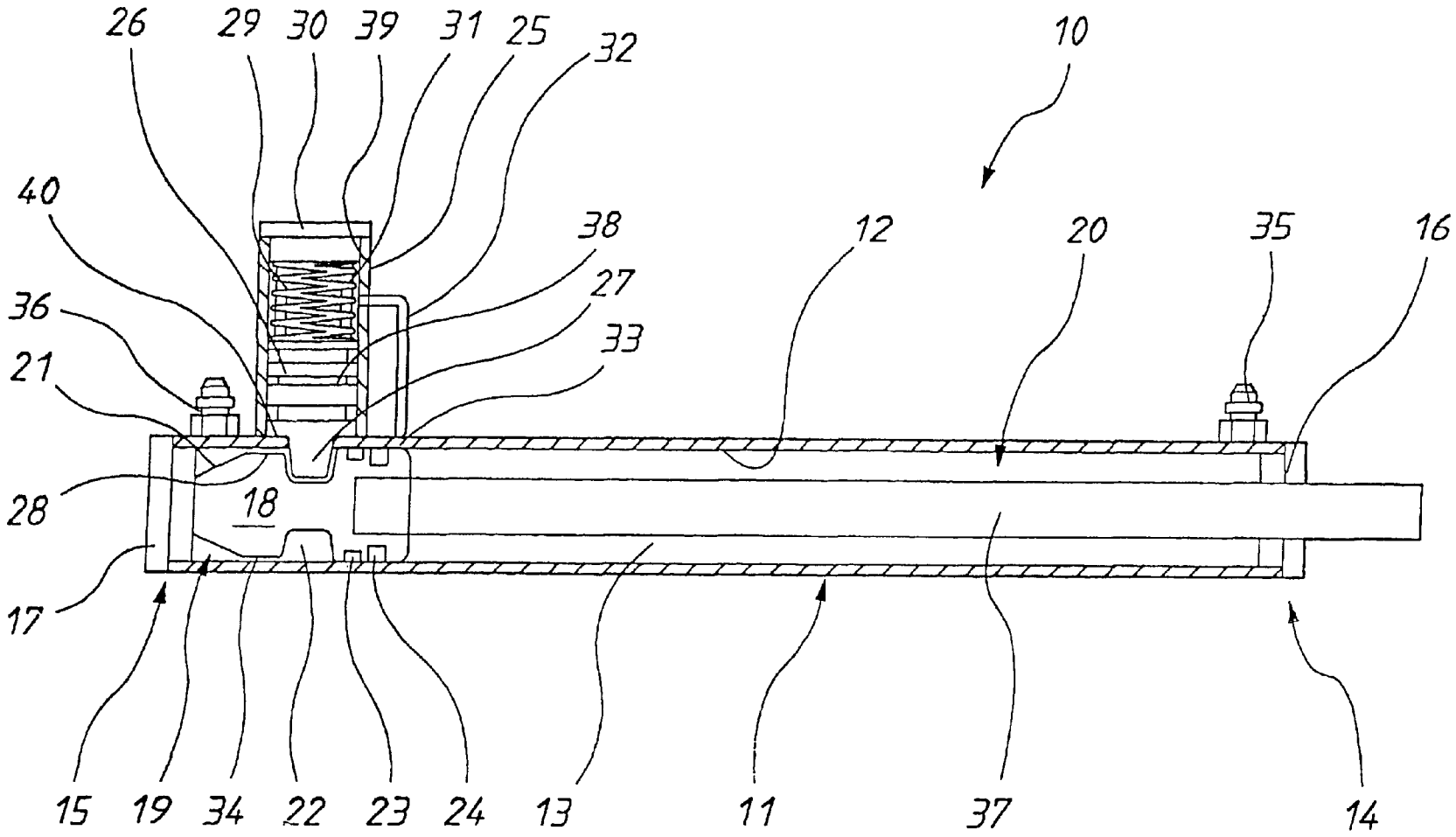

In the accompanying drawing there is schematically depicted a hydraulic or pneumatic cylinder 10. The cylinder 10 has a body 11 providing a bore 12 generally surrounding a chamber 13. The chamber 13 has opposite ends 14 and 15 which are closed by plug members 16 and 17.

Mounted within the body 11 and slidably engaging the cylindrical surface of the bore 12 is a piston 18. The piston

18 divides the chamber 13 into a first sub-chamber 19 and a second sub-chamber 20. The piston 18 has a tapered leading surface 21 which is of frusto-conical configuration. The piston is further provided with an annular recess 22 as well as a wear ring 23 and seal 24.

The body 11 includes a housing 25 providing a bore 39 which slidably receiving and guiding a pawl 26. The pawl 26 has a leading projection 27 which is aligned with an aperture 28 in the body 11. A spring 29 urges the pawl 26 to a position at which the projection 27 is located within the chamber 13.

Located between the pawl 26 and an end cap 30 is a locking chamber 31 within which the spring 29 is located. Extending from the chamber 31 is a duct 32 extending to an aperture 33. The aperture 33 communicates with the sub-chamber 20 when the piston 18 is located adjacent the end 15.

The piston 18 is sized so that there is an annular space 34 permitting fluid to pass from the sub-chamber 19 to a position at which pressure can be applied to the pawl 26.

Extending from the body 11 is a first fluid coupling 36 which provides for movement of fluid relative to the sub-chamber 19 while a second fluid coupling 35 provides for movement of fluid relative to the second sub-chamber 20.

Attached to and extending from the piston 18 is a piston rod 37 which exits via the plug member 16 which sealingly engages the longitudinal peripheral surface of the piston rod 37.

In operation of the above described hydraulic cylinder 10, fluid under pressure is delivered to the sub-chamber 19. Fluid passing the passage 34 and entering the chamber 40 causes retraction of the pawl 26 to a position at which the projection 27 is no longer engaged within the recess 22. Pressure within the sub-chamber 19 causes movement of the piston 18 toward the end 14. Fluid is allowed to leave the sub-chamber 20 via the fluid coupling 35. When the pawl 26 moves to its retracted position, fluid within the chamber 31 is allowed to return to the chamber 13 via the duct 32. When the piston 18 is spaced from the end 17 and fluid under pressure is delivered to the sub-chamber 20, the piston 18 moves towards the end 15 and engages the projection 27. The tapered surface 21 engages the projection 27 and causes the pawl 26 to move to a position at which the piston 18 can pass. Once the piston 18 is in the position depicted, the pawl 26 moves to a position at which the projection 27 is engaged within the recess 22. Fluid from the sub-chamber 20 passes through the duct 32 to urge the pawl 26 to engage within the recess 22. This movement is enhanced by means of the spring 29.

The above mentioned duct 32 also enables the cylinder 10 to be used in a phasing circuit. In relation to the cylinder 10 being used in a phasing circuit, the pawl 26 is provided with a single acting seal 38 which permits the flow of fluid only from the chamber 31 past the pawl 26 to enter the sub-chamber 19. When the cylinder 10 is used in a phasing circuit and the piston 18 located adjacent the end 15, fluid can flow via the duct 32 past the seal 38 to exit via the coupling 36 from where it would pass to the next cylinder. Reverse flow is prevented by the seal 38.

The above preferred embodiment ensures that the piston 18 is retained adjacent the end 15 until fluid under pressure is delivered to the sub-chamber 19.

What is claimed is:

1. A hydraulic or pneumatic cylinder including:

a bore generally surrounding a chamber having opposite ends;

a piston in said bore and co-operating therewith to divide said chamber into a first and a second sub-chamber;

a piston rod fixed to and extending from said piston and extending beyond one of said ends;

means closing said opposite ends;

releasable locking means to retain said piston at a desired location within said bore, said locking means being releasable to permit movement of said piston upon delivery of a fluid under pressure to one of said sub-chambers; and duct means extending from the bore to provide for fluid flow from said second sub-chamber to said first sub-chamber when said locking means is engaged with said piston to retain said piston at said desired location, wherein said duct means is closed when said piston is displaced from said desired location.

2. The cylinder of claim 1 wherein the locking means includes a pawl moveable relative to said bore, and a recess in said piston, said recess being alignable with said pawl so as to be engaged therewith to retain the piston at said desired location, said pawl being movable between a first position at which it is engaged within said recess and a second position spaced from said recess to provide for movement of said piston.

3. The cylinder of claim 2 further including a spring urging said pawl into engagement with said recess.

4. The cylinder of claim 3 wherein delivery of fluid under pressure to said first sub-chamber causes movement of said pawl transversely relative to said bore from said first position to said second position thereof.

5. The cylinder of claim 1 wherein said locking means includes:

a further bore; and a pawl slideably located in said further bore so as to be moveable between a first position at which said pawl is engaged with said piston to retain said piston at said desired location, and a second position at which the pawl releases said piston.

6. The cylinder of claim 5 further including a spring urging said pawl to the first position thereof.

7. The cylinder of claim 6 wherein said piston has a recess alignable with said pawl, with said pawl being located in said recess when said pawl is in said first position.

8. The cylinder of claim 5 wherein said further bore and pawl co-operate to provide a lock chamber; and said duct means includes: a duct providing for communication between said lock chamber and said second chamber to provide for the flow of fluid there between.

9. The cylinder of claim 8 wherein said duct means includes:

passage means which also provides for the flow of fluid from said first sub-chamber to engage said pawl to move said pawl from said first position to said second position so that said pawl releases said piston.

10. The cylinder of claim 9 wherein said passage means is located between said piston and the associated bore.

11. The cylinder of claim 10 wherein said piston has a ramp portion to engage said pawl to enable the piston to move thereby.

12. The cylinder of claim 11 wherein said pawl has a single acting seal providing for the flow of fluid only from said second sub-chamber to said first sub-chamber through said duct and passage means, which single acting seal prevents flow from said first sub-chamber to said second sub-chamber via said duct and passage means.

* * * * *